US006805583B2

(12) United States Patent
Holliday et al.

(10) Patent No.: US 6,805,583 B2
(45) Date of Patent: Oct. 19, 2004

(54) MINI-COAX CABLE CONNECTOR AND METHOD OF INSTALLATION

(75) Inventors: Randall A. Holliday, 4360 Augusta Dr., Broomfield, CO (US) 80020; Sheng Chia Wong, Taipei (TW)

(73) Assignee: Randall A. Holliday, Broomfield, CO (US)

( * ) Notice: Subject to any disclaimer, the term of this patent is extended or adjusted under 35 U.S.C. 154(b) by 0 days.

(21) Appl. No.: 10/313,787

(22) Filed: Dec. 6, 2002

(65) Prior Publication Data

US 2004/0110418 A1 Jun. 10, 2004

(51) Int. Cl.[7] ..... H01R 9/05
(52) U.S. Cl. ..... 439/578
(58) Field of Search ..... 439/578–585

(56) References Cited

U.S. PATENT DOCUMENTS 3,601,524 A * 8/1971 Kauffman
5,232,377 A * 8/1993 Leibfried et al.
5,392,508 A * 2/1995 Holliday et al.
5,480,325 A * 1/1996 Tran et al. ..... 439/578
5,548,088 A * 8/1996 Gray et al. ..... 439/578
5,596,800 A * 1/1997 Holliday et al.
5,651,698 A * 7/1997 Locati et al.
5,769,662 A * 6/1998 Stabile et al.
5,938,465 A * 8/1999 Fox, Sr. ..... 439/578
6,027,373 A * 2/2000 Gray et al. ..... 439/578
6,159,046 A * 12/2000 Wong
6,179,656 B1 * 1/2001 Wong
6,332,815 B1 * 12/2001 Bruce ..... 439/578
6,352,448 B1 * 3/2002 Holliday et al.
6,406,330 B2 * 6/2002 Bruce ..... 439/578
6,517,379 B2 * 2/2003 Leve ..... 439/578

* cited by examiner

*Primary Examiner*—Gary Paumen
(74) *Attorney, Agent, or Firm*—John E. Reilly

(57) ABSTRACT

An adaptor or termination assembly for a mini-coax cable is made up of an extension tip which receives the inner conductor pin on the cable, a first sleeve which fits over an exposed end of the dielectric layer, and a second sleeve which surrounds an exposed end of the outer conductor, all as a preliminary to inserting the assembly into a standard sized connector body and assuring a positive connection between the cable and connector body in such a way as to avoid creating impedance which will downgrade the signal passing through the cable into the connector.

23 Claims, 3 Drawing Sheets

MINI-COAX CABLE CONNECTOR AND METHOD OF INSTALLATION

BACKGROUND AND FIELD OF INVENTION

This invention relates to coaxial cable connecting devices; and more particularly relates to a novel and improved adapter for connecting mini-coax cables to a connector.

Mini-coax cables are increasingly being used in installations having space limitations and where only a short run of cable is needed. Typically, the mini-coax cables are on the order of 2.5 mm. to 4 mm. in diameter. Typical applications for such cables are for security cameras as well as telecommunications. A difficulty in using the smaller cables however is in manually preparing the cable to connect to a post or terminal in the field. For example, there is the problem of separating the conductive and non-conductive layers when preparing the end of the cable for connection and in such a way as to prevent shorting between layers. A typical example is in connecting to a BNC connector having a preassembled crimping ring, such as, that set forth and described in my U.S. Letters Pat. No. 6,352,448. It is extremely difficult to force 2 sleeve on the BNC connector between the dielectric and braided layers and often leads to shorting between the conductive braid layer and center conductor wire or pin. Furthermore, it is important to be able to maintain proper alignment and centering of the interconnecting conductor wire or pin at the lead end of the cable when advancing into position within the BNC connector as well as to promote ease of positive connection to avoid creating an impedance tending to downgrade the signal through the cable and connector.

From the foregoing, there is a definite need for an adapter for coaxial cables and particularly the smaller diameter cables which will overcome the aforementioned problems and result in a positive, secure connection between the cable and connector in a minimum number of steps.

SUMMARY OF THE INVENTION

It is therefore an object of the present invention to provide for a novel and improved adapter for coaxial cables.

It is another, object of the present invention to provide for a novel and improved adapter for small diameter coaxial cables which can be installed in the field in a minimum number of steps with minimal tooling required.

It is a further object of the present invention to provide for a novel and improved adapter for coaxial cable installations which assures accurate alignment between the cable and connector preliminary to crimping of the connector onto the cable and prevents shorting between the cable layers with one another as well as with conductive portions of the connector.

It is a still further object of the present invention to provide for a novel and improved adapter for preparing the end of a coaxial cable for installation into an end connector having a preassembled crimping ring.

In accordance with the present invention, an adapter is provided for connecting the end of a coaxial cable to a hollow connector body wherein the cable is of the type having inner and outer concentric electrical conductors, an annular dielectric separating the conductors and an outer jacket of electrically non-conductive material, the inner and outer conductors being exposed and the inner conductor projecting beyond the dielectric at one end of the cable; and the adapter comprises an extension member including a tip of electrically conductive material provided with a recess into which the inner conductor can be inserted, a first sleeve of electrically non-conductive material surrounding the dielectric layer, and a second sleeve of electrically conductive material surrounding the exposed end of the outer conductor. In a preferred form thereof, the first sleeve is dimensioned such that it can be advanced over the extension tip and will cause a trailing end of the extension tip to be compressed snugly into firm engagement with the central conductor pin. Further, the second sleeve is dimensioned to advance over both the tip and plastic sleeve, and a reduced or thicker portion of the second sleeve will bear against an enlarged portion of the first sleeve and at the same time stiffen or rigidify the entire adapter assembly. The sleeves are dimensioned such that a standard size crimping ring, for example, on a BNC connector will cause the second sleeve to be compressed into sealed engagement with the end of the cable, and the first sleeve will insulate the outer conductive braided layer from to prevent shorting. In addition, a trailing end of the second sleeve is slotted to divide the trailing end into prong-like segments having internal and external teeth so that the trailing end of the second sleeve can be compressed into engagement with the cable without crushing the dielectric layer.

Further in accordance with the present invention, one method of installing a cable of the type described in a hollow connector body comprises the steps of inserting the inner conductor into a recessed end of an extension member, inserting the extension member into a first sleeve composed of electrically non-conductive material until the first sleeve bears against an end of the material, and inserting the extension member and first sleeve into a second sleeve and advancing the second sleeve over the first sleeve until a trailing end of the second sleeve overlies a portion of the outer conductor, and the second sleeve can be contracted into engagement with the outer conductor.

The above and other objects, advantages and features of the present invention will become more readily appreciated and understood from a consideration of the following detailed description of a preferred form of the present invention when taken together with the accompanying drawings in which:

DETAILED DESCRIPTION OF PREFERRED EMBODIMENTS

Figure 1:
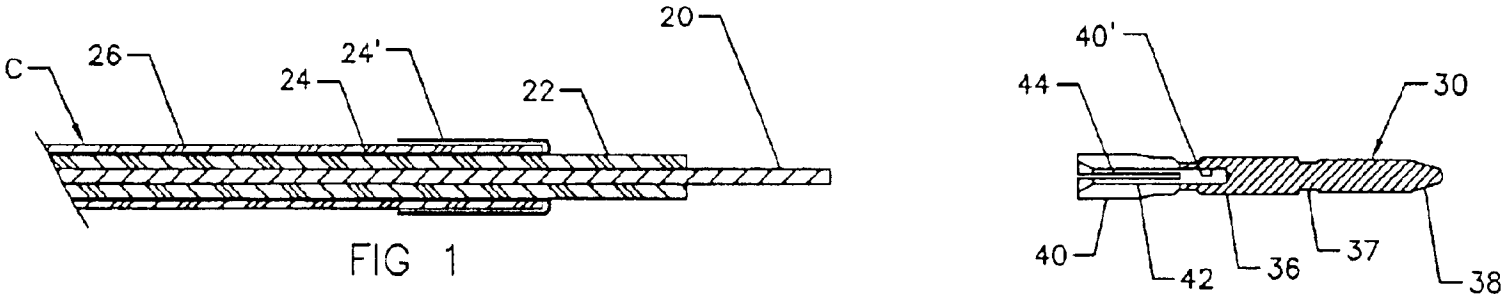
FIG. 1 is an exploded, longitudinal section view of one form of mini-coax cable and a tip.

Referring in more detail to the drawings, the present invention may be best typified by describing a novel form of termination assembly in combination with a standard RGB mini-coax cable C and a BNC connector 12 modified in a manner to be described. As a setting for the present invention, the cable C is made up of an inner or central conductor pin or wire 20 which is surrounded by a dielectric insulator 22 of electrically non-conductive material, such as, a rubber or rubber-like material, a braided conductor layer 24, and an outer jacket 26 of an electrically non-conductive material, such as, a rubber or rubber-like material. The end of the cable C is further prepared for assembly by removing a limited length of the outer jacket 26 and braided conductor 24, and another limited length of the insulator layer 22 is removed to expose an end of the pin 20 along with the foil layer, not shown, surrounding the pin 20. The braided conductor layer 24 is peeled back and away from the insulator 22 and doubled over as at 24' to cover the leading end of the jacket 26.

Figure 2:
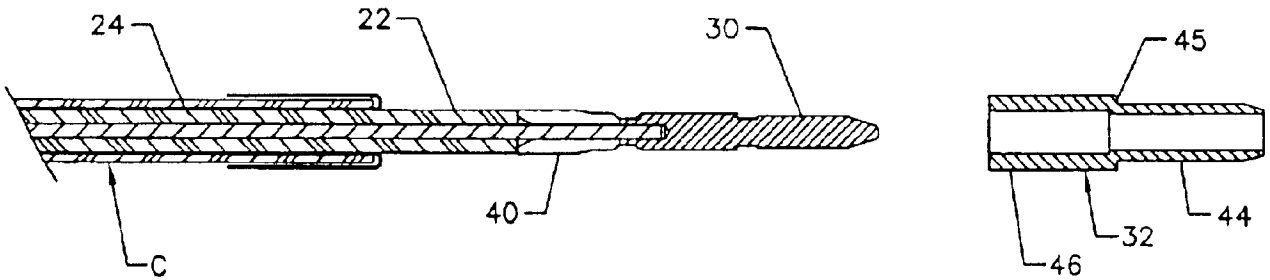
FIG. 2 is another exploded, longitudinal section view of the cable and assembled tip shown in FIG. 1 and a first sleeve to be assembled onto the cable.
Figure 3:
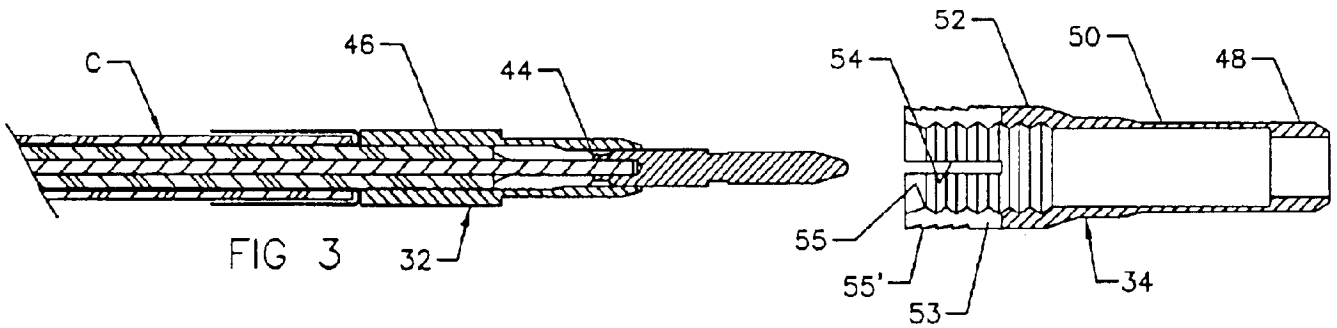
FIG. 3 is another exploded, longitudinal section view of the cable assembly shown in FIG. 2 with the sleeve of FIG. 2 assembled and a second sleeve preliminary to assembly onto the cable.
Figure 4:
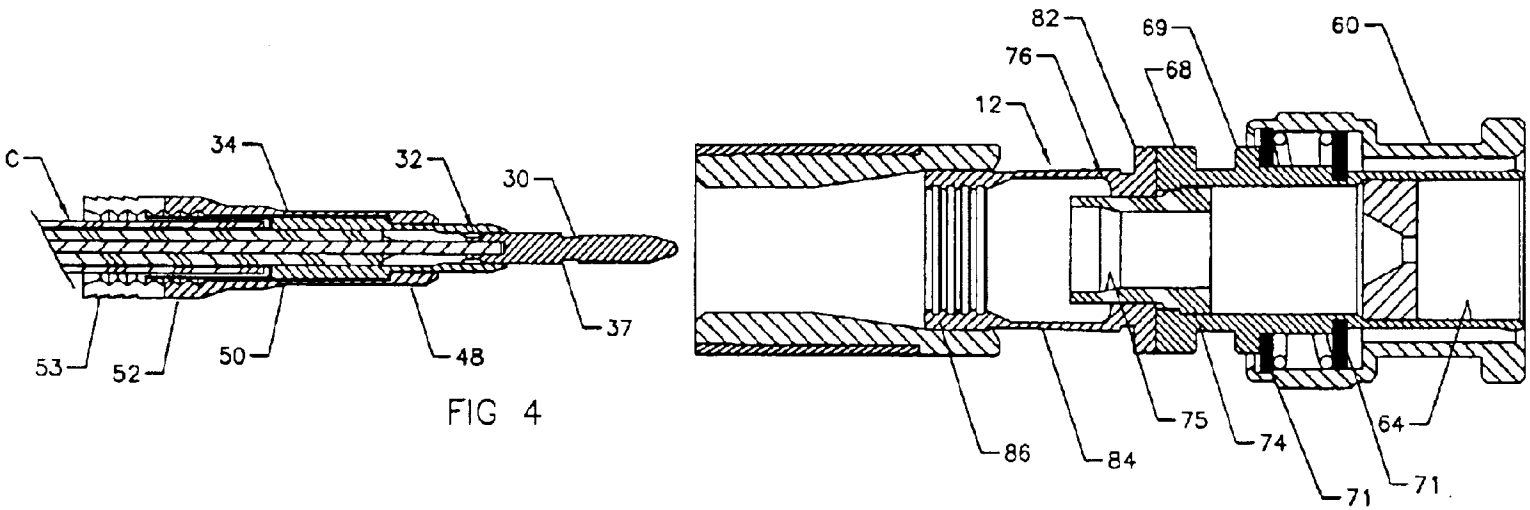
FIG. 4 is another exploded, longitudinal section view of the preferred form of cable assembly with the first and second sleeves assembled preliminary to insertion into a connector.

In accordance with the present invention, the leading end of the cable C is further prepared by a termination assembly or adapter which is defined by an extension member including a tip 30, first sleeve 32 and second sleeve 34 combined into assembled relation onto the end of the cable C, as illustrated in succession in FIGS. 2 to 4. The tip 30 is composed of an electrically conductive material, such as, metal and is in the form of an elongated slender body 36 terminating in a rounded nose 38 at one end and in a slightly enlarged portion 40 which is recessed at the opposite trailing end. The end portion 40 defines an elongated opening or bore 40' and is separated into split end portions 42 by diametrically opposed slots 44. The end portion 40 is dimensioned to receive the full length of the center conductor pin 20 so that the end portion 40 of the tip 30 bears against the leading end of the dielectric 22.

The first sleeve 32, as shown in FIG. 2, is of an electrically non-conductive material and is of generally tubular configuration having a relatively thin-walled leading tubular portion 44 and relatively thick-walled and enlarged trailing tubular portion 46 and shoulder 45 therebetween. The sleeve is dimensioned to fit snugly over the tip 30 to a position such that the leading tubular portion 44 is in surrounding relation to the slotted end 40 of the tip, and the trailing tubular portion 46 is in surrounding relation to the inner dielectric layer 22 and bears against the end of the doubled-over braided portion 24'.

The metal sleeve 34, as shown in FIG. 3, includes a hollow end portion 48 of reduced diameter with respect to the rest of the sleeve and which is adapted to move into snug-fitting relation to the reduced portion 44 of the first sleeve and to bear against shoulder 45 on the first sleeve. A longer portion 50 of the sleeve is of increased diameter with respect to the shorter reduced diameter portion 48 and is sized to fit snugly over the enlarged surface 46 of the first sleeve. The longer portion 50 terminates in a relatively thick-walled end portion 52 having two pair of diametrically opposed, open longitudinal slots 54 which divide the end portion 52 into quadrants or arcuate segments 53, and the segments 53 are provided with internal and external teeth 55 and 55', respectively. The segments 53 are prong-like and overlie the doubled-over portion 24' of the braided layer 24 as well as a limited portion of the jacket 26 when the sleeve 34 is assembled onto the cable C.

Figure 5:
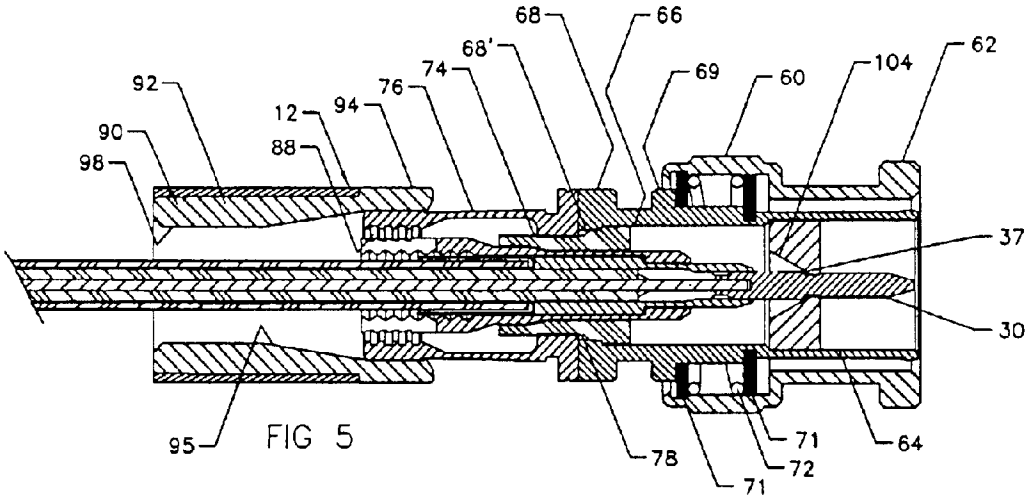
FIG. 5 is a sectional view illustrating the preferred form of cable assembly in a fully inserted position within the connector preliminary to crimping the connector into engagement with the cable assembly.
Figure 6:
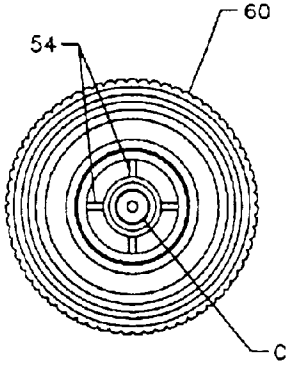
FIG. 6 is an end view of the assembly shown in FIG. 5.

Referring to FIGS. 4 to 6, the connector 12 may be broadly characterized as being of the BNC type including a ferrule 60 with a bayonet slot, not shown, in a leading cylindrical end portion 62 of the ferrule for the purpose of attachment to a suitable post or terminal, not shown, but in accordance with well-known practice. The ferrule 60 is in outer spaced concentric relation to a cylindrical casing 64 which extends beyond the length of the ferrule and includes a rearward extension 66 with axially spaced, external shoulders 68 and 69. A pair of spacers 71 serve to interconnect and space the ferrule in surrounding relation to the casing 64 as well as to serve as limit stops for a spring element 72. Inner and outer spaced concentric sleeves 74 and 76 project from the end portions or shoulders 68 of the ferrule 60. The inner sleeve 74 is of gradually increasing thickness to terminate in an enlarged end 78 which is inserted in pressfit relation to an inner reduced surface portion 68' of the end portion 68. An inner surface 80 of the sleeve 74 is dimensioned to receive the tip 30 and assembled sleeve 32 with the outermost sleeve 34 slidable axially through the sleeve 74 until the tapered wall of the portion 50 moves into engagement with a complementary inner surface portion 75 at the trailing end of the sleeve 74.

The outer sleeve 76 is composed of a metal or other electrically conductive material including an enlarged annular end portion 82 which bears against the external surface of the inner sleeve 74 as well as the shoulder 68 with a thin-walled cylindrical extension 84 extending rearwardly from the enlarged end 82 and terminating in a thickened end 86 having inner endless ribs or sealing rings 88. The inner diameter of the end portion 86 is of a normal dimension greater than that of the end portion 52 of the sleeve 34 but is compressible under radial contraction into positive engagement with the end portion 52 as well as a limited surface portion of the jacket 26 in a manner to be described.

Figure 7:
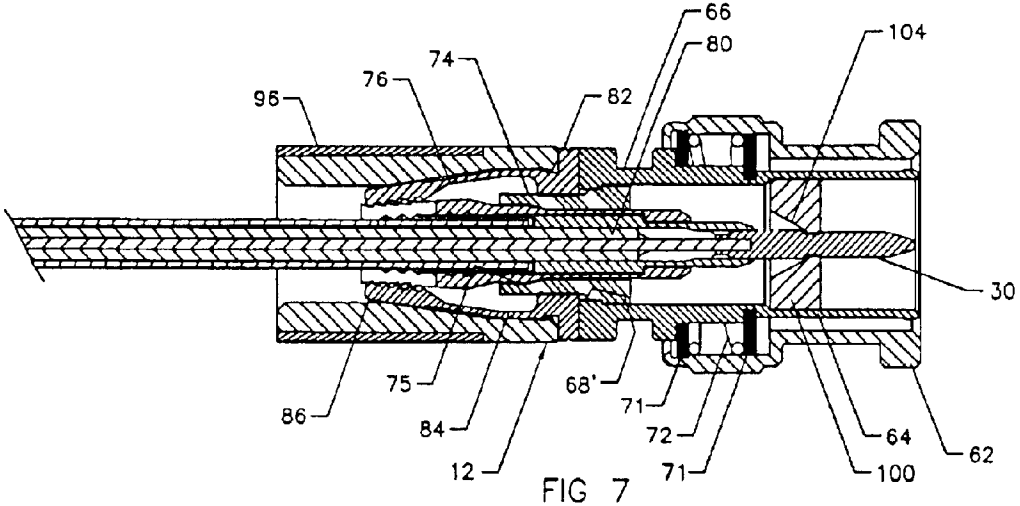
FIG. 7 is a sectional view similar to FIG. 5 after the crimping operation is completed.
Figure 8:
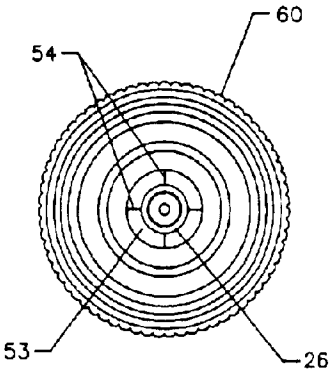
FIG. 8 is an end view of the assembly shown in FIG. 7.

The connector 12 is completed by a crimping ring 90 which is of a type that can be preassembled on the connector 12 and axially advanced over the outer sleeve 76 to force it into crimping engagement with the slotted end 54 of the sleeve 34 as well as the outer jacket 26. For this purpose, the crimping ring 90 is made up of an annular body 92 composed of a low-friction material having limited compressibility, such as, DELRIN® or other hardened plastic material. One end 94 of the body 92 is relatively thin-walled having an internal diameter equal to or slightly less than the external diameter of the sleeve 76 so that the crimping ring can be pressfit onto the end of the connector 12. The body 92 thickens rearwardly away from the end portion 94 in defining a tapered internal surface 95 leading into a cylindrical end portion 98. An exterior surface of the body 92 is undercut to receive a reinforcing band 96 which is preferably composed of brass and which fits snugly over the ring body 92 and has an external diameter substantially equal to that of the end portion 94. Accordingly, axial advancement of the crimping ring 90 over the sleeve 52 will cause the end portion 86 to be radially compressed until the ribs 88 move into tight-fitting, sealed engagement with the end 52 of the sleeve 32 and, in turn, cause radial compression of the segments 53 into tight-fitting engagement with the doubled-over portion 24' of the braided layer 24 and the jacket 26. An important feature of the invention is to dimension the slotted end 52 and specifically the width of the slots 54 to limit the amount of compression of the segments 53 so that the teeth 55 will compress the jacket 26 enough to prevent pull-out but not enough to crush the dielectric layer 22. Thus, the segments 53 can be compressed from the open position shown in FIGS. 5 and 6 to a position shown in FIGS. 7 and 8 in which the segments 53 are compressed only until the slots 54 between the segments 53 are closed. Accordingly, the width of the slot 54 will control the degree or amount of radial inward contraction of the segments 53 to prevent crushing of the dielectric layer 22. This is especially important in cables operating at higher bandwidth frequencies in which any bending or crushing of the dielectric can create an impedance that downgrades the signal and prevents good return loss.

The connector 12 includes a pin-receiving disk 100 which is mounted across the casing 66 just forwardly of the spacers 71. The disk 100 is of electrically non-conductive material, such as, a plastic and is provided with a generally conical or tapered opening 104 which serves to guide the tip 30 into centered relation to the connector when the cable C is installed in the connector. The disk 100 is of limited resiliency so that the tip 30 can be given a diameter slightly larger than the opening 104 and be forced to expand by the tip 30 as the tip 30 is advanced through the opening until the opening snaps into engagement with an external groove 37 on the tip 30.

From the foregoing, the preferred method of installation of the coaxial cable C in the connector body 12 comprises the steps of first preparing the end of the cable C as described by exposing the center conductor pin 20 and dielectric 22 as shown in FIG. 1. The center conductor 20 is stripped as well as the dielectric 22 using a standard wire-stripping tool, followed by folding the cable braid 24 back over the jacket 26 and entirely away from the dielectric 22 so that no part of the braid is in contact with the center conductor 20. The conductor pin 20 is then inserted into the end of the tip 30. The tip 30 is inserted into the sleeve 32 until the sleeve 32 covers the exposed dielectric 22, followed by inserting the tip 30 and sleeve 32 into the outer metal sleeve 34 until the sleeve 34 covers the doubled-over portion 24' of the braid.

The completed assembly of the tip 30 and sleeves 32 and 34, referred to as the termination assembly, has sufficient stability to be inserted into the connector 12 until the tip 30 has advanced, as shown in FIG. 5, through the center opening 104 and until the groove 37 on the tip 30 snaps into position with the surrounding edge of that opening.

A standard crimping tool may be employed to axially advance the crimping ring 90 over the sleeve 76 thereby causing the end portion 86 of the sleeve 76 to radially contract and force the ribs 88 into positive engagement with serrations or teeth 55 on the slotted end 52 and in turn causing the end 52 to be crimped into positive engagement with the jacket 26 as well as the braided portion 24'. One such tool is set forth and described in copending U.S. patent application Ser. No. 09/960,566 for UNIVERSAL CRIMPING TOOL, filed Sep. 20, 2001 and is incorporated by reference herein. The cooperation between the ribs 88 when forced into the teeth 55' and in turn forcing the internal teeth 55 into engagement with the braided layer 24' as well as the jacket 26 increases the pull-out strength of the termination assembly both with respect to the end of the cable C and of the connector 12.

Mini-coaxial cables are particularly useful in cellular telephones, security cameras and other applications where there are decided space limitations or where short runs of cable are used. It will be evident that the size and proportion of extension tip 30, sleeves 32 and 34 may be varied according to specific wire or cable diameters and proportioned according to the space allowances between the cable C and the connector 12. Similarly, the width of the slots 54 may be varied in accordance with the amount of contraction required of the segments 53 to firmly engage the jacket 26 without crushing the dielectric layer 22 as previously described.

It is therefore to be understood that while a preferred form of method and apparatus is herein set forth and described, various modifications and changes may be made in the construction and arrangement of parts as well as the specific method of installation without departing from the spirit and scope of the present invention as defined by the appended claims and reasonable equivalents thereof.

We claim:

1. An adapter for connecting a male end of a cable to a hollow connector body wherein the cable is of the type having inner and outer concentric electrical conductors, an annular dielectric separating said conductors, and an outer jacket of electrically non-conductive material, said inner and outer conductors having exposed portions, said adapter comprising:

an extension member of electrically conductive material provided with a recess at one end to receive said exposed portion of said inner conductor, and longitudinal slots in surrounding relation to at least a portion of said recess and being engageable with said dielectric;

a first sleeve of electrically non-conductive material engaging said dielectric; and a second sleeve of electrically conductive material contacting said exposed portion of said outer conductor.

2. An adapter according to claim 1 wherein said first sleeve includes a leading end in surrounding relation to said one end of said extension member and a trailing end in surrounding relation to said exposed portion of said dielectric.

3. An adapter according to claim 2 wherein said trailing end of said first sleeve bears against a leading edge of said outer conductor.

4. An adapter according to claim 3 wherein said second sleeve includes a leading end in surrounding relation to said leading end of said first sleeve and a trailing end in surrounding relation to said exposed portion of said outer conductor.

5. An adapter according to claim 4 wherein said trailing end of said second sleeve is provided with circumferentially spaced longitudinal slots defining arcuate segments provided with internal and external circumferentially extending teeth.

6. An adapter according to claim 1 wherein said extension members includes a tip, said connector body includes a crimping ring at one end of said body and a tip-receiving, transverse retainer axially spaced from said crimping ring.

7. An adapter according to claim 6 wherein said body includes a clamping sleeve in a leading end of said crimping ring, said clamping sleeve being radially contracted into clamping engagement with said trailing end of said second sleeve in response to axial advancement of said crimping ring over said clamping sleeve.

8. An adapter according to claim 5 wherein said slots are dimensioned to be of a width to limit radial inward contraction of said segments into clamping engagement with said jacket without crushing said dielectric.

9. An adapter according to claim 6 wherein said connector body includes an annular support to receive said second sleeve when said tip is advanced into engagement with said transverse retainer.

10. An adapter according to claim 9 wherein said transverse retainer includes a central opening for insertion of said tip therethrough, said transverse retainer being mounted relatively near said leading end of said connector body and away from said trailing end of said body.

11. In an assembly for connecting an end of a mini-coax cable to a hollow connector body wherein the cable is of the type having inner and outer concentric electrical conductors, an annular dielectric separating said conductors and an outer jacket of electrically non-conductive material, said inner and outer conductors having exposed portions and said inner conductor projecting beyond said dielectric at one end of said cable, the improvement comprising:

an extension tip of electrically conductive material provided with a hollow end portion into which said inner conductor is inserted;

a first sleeve of electrically non-conductive material surrounding said dielectric;

a second sleeve of electrically conductive material in electrical contact with said exposed portion of said outer conductor; and a crimping ring disposed substantially at one end of said body and a tip-receiving retainer member axially spaced from said crimping ring.

12. In an assembly according to claim 11 wherein said hollow end Portion extends in snug-fitting engagement with a trailing end of said tip, said trailing end having longitudinal slots therein.

13. In an assembly according to claim 11 wherein said extension member includes a tip, and said tip includes a leading end portion which is provided with an external groove therein.

14. In an assembly according to claim 11 wherein said first sleeve includes a leading end in surrounding relation to said trailing end of said tip and a trailing end in snug-fitting engagement with a leading end of said dielectric.

15. In an assembly according to claim 11 wherein said trailing end of said first sleeve bears against a leading edge of said outer conductor, a leading end in surrounding relation to said leading end of said first sleeve and a trailing end in snug-fitting engagement with said exposed portion of said outer conductor.

16. In an assembly according to claim 15 wherein said trailing end of said second sleeve is provided with circumferentially spaced longitudinal slots dimensioned to be of a width to limit inward radial contraction of said second sleeve trailing end to prevent crushing of said dielectric.

17. In an assembly according to claim 13 wherein said connector body includes a crimping king at one end of said body and a pin-receiving, transverse retainer axially spaced from said crimping ring, said groove being movable into snap-fitting engagement with said retainer.

18. In an assembly according to claim 17 wherein said connector body includes a clamping sleeve which receives a leading end of said crimping ring, said clamping sleeve being radially contracted into clamping engagement with said trailing end of said second sleeve in response to axial advancement of said crimping ring over said clamping sleeve.

19. In an assembly according to claim 18 wherein said crimping ring has an inner tapered wall surface, said body including an annular support engageable with said second sleeve when said tip is advanced into engagement with said transverse retainer.

20. In an assembly according to claim 17 wherein said transverse retainer includes a central opening for insertion of said tip until said groove moves into alignment with said opening.

21. A method of installing a coaxial cable in a hollow connector body wherein said cable has inner and outer spaced concentric electrical conductors separated by an annular dielectric and an outer insulating jacket in surrounding relation to said outer conductor, said inner conductor projecting beyond said dielectric layer at one end of said cable and said outer conductor being doubled over said jacket, the steps comprising:

inserting said inner conductor into a recessed end of a tip;

inserting said tip into a first sleeve composed of electrically non-conductive material until said first sleeve bears against an end of said dielectric; and inserting said tip and said first sleeve into a second sleeve having longitudinal slots therein, said second sleeve composed of an electrically conductive material and advancing said second sleeve over said first sleeve until a slotted trailing end of said second sleeve overlies said doubled-over portion of said outer conductor.

22. The method according to claim 21, wherein said connector body includes a tip-receiving member and a clamping sleeve and including the further step of inserting said end of said cable into said body until said tip advances into engagement with said tip-receiving member and said second sleeve is disposed in said clamping sleeve.

23. The method according to claim 22 including the further step of clamping said clamping sleeve inwardly into positive engagement with said second sleeve until said second sleeve trailing end is contracted to a sufficient degree as to close said slots.

* * * * *